US005784980A

United States Patent [19]

Benefiel

[11] Patent Number: 5,784,980

[45] Date of Patent: Jul. 28, 1998

[54] AQUATIC PLATFORM WITH ANTI-ROOSTING SYSTEM

[76] Inventor: John R. Benefiel, 6005 Upper Straits Blvd., West Bloomfield, Mich. 48234

[21] Appl. No.: 733,977

[22] Filed: Oct. 18, 1996

Related U.S. Application Data

[60] Provisional application No. 60/005,363 Oct. 19, 1996.

[51] Int. Cl. [6] ..... B63B 35/44; E04B 1/72

[52] U.S. Cl. ..... 114/263; 114/343; 52/101

[58] Field of Search ..... 119/903; 52/101; 114/263, 270, 264, 266, 267, 343, 364; 441/1

[56] References Cited

U.S. PATENT DOCUMENTS

| | | | |
|---|---|---|---|
| 3,065,721 | 11/1962 | Roudabush | 114/263 |
| 3,126,855 | 3/1964 | Freeburg | 114/263 |
| 5,410,982 | 5/1995 | Mann | 52/101 |

*Primary Examiner*—Edwin L. Swinehart
*Attorney, Agent, or Firm*—John R. Benefiel

[57] ABSTRACT

An aquatic platform such as a swimming raft is equipped with an anti-roosting system comprised of a series of opaque panels which can be moved to a raised position blocking outward viewing of fowl alighting on the surface of the platform and deterring roosting thereon. The panels are released to be moved to a stowed position below the platform surface when the platform is in use.

7 Claims, 2 Drawing Sheets

AQUATIC PLATFORM WITH ANTI-ROOSTING SYSTEM

CROSS-REFERENCE TO RELATED APPLICATION

This application is based on provisional application U.S. Ser. No. 60/005,363, filed Oct. 19, 1996.

BACKGROUND OF THE INVENTION

This invention concerns aquatic platforms such as swim rafts, docks, and the like which are supported above the surface of a body of water.

Such platforms are often unfrequented by human users for long periods of time, and in the absence of any human presence, various fowl tend to roost on the platform surface, often in flocks. Water fowl seem to prefer spending time out of the water to preen their feathers, etc., while remaining close to the body of water which they normally inhabit.

Gulls and ducks often roost during the day, and flocks of geese have been known to use swimming rafts as a nighttime roost.

The roosting of larger fowl as these results in fouling of the surface with feathers, fecal droppings, etc. Where many birds are involved, the entire surface can be completely covered with debris.

Since such platforms are often desired to be used as a swim platform or for sunbathing, this situation is of course unacceptable and the top surface must be thoroughly scrubbed down prior to use. The fouled condition of the surface redevelops after a short time so that the user must clean the surface each time he or she uses the platform.

Scrubbing of the surface often results in fecal droppings being swept into the water surrounding the platform, obviously undesirable where swimming off the platform is contemplated.

Anti-roosting or surface protective devices have thus heretofore been devised, usually consisting of a covering of some material placed over the platform to deter roosting or at least preventing the droppings from soiling the carpeting or other top surface covering. These devices often do not work or are inconvenient to use as they involve considerable time and effort to set up and take down. Often bulky pieces are involved which must be stowed, often at a distance from the platform. In connection with swim rafts in particular which may only be infrequently used, it is particularly desirable to have a quick, convenient setup and takedown.

Simple covers still result in fecal droppings being deposited into the water when the cover is removed.

It is therefore the object of the present invention to provide an anti-roosting system for aquatic platforms which is effective to entirely prevent roosting, while being quite convenient to use as not involving any substantial time to setup or takedown, nor the necessity to stow components of the system.

SUMMARY OF THE INVENTION

The present inventor has discovered that waterfowl tend to not roost at locations whereat their ability to view the surrounding area is prevented. This is believed to be a result of natural wariness and perhaps in the case of scavengers such as gulls due to an instinctive preference to observe everything around them for some distance to locate food.

The anti-roosting system according to the present invention comprises a series of opaque panels arranged about the sides of the platform, each panel mounted to a respective side of the platform so as to be able to be moved up to a raised, vertical position, where they are held by a relatively releasable holder. If the panels are hingedly mounted to be swingable between their raised and lowered, stowed positions, the panels may be hooked or otherwise connected at their contiguous side edges to be held supported by each other in their raised position.

This creates a visual barrier enclosing the platform at a height calculated to block the outward viewing of a roosting fowl. A height of about 12 to 20 inches has been found sufficient for common waterfowl including geese.

The raised panels may also make landing and taking off from the platform surface more troublesome for the heavier birds, particularly for small area swim platforms.

The corners formed at adjacent panel sides may be connected by readily connectable elements such as hooks, locking pins, short cables, or chains cooperating with corner pieces such as to allow the panels to be held their raised, release, or lowered position to allow them to be quickly and easily moved.

The panels may also be slidably mounted to be moved up or down, and in this case, a detent mechanism or lock pins can be used to hold the panels in their raised position.

The panels are self-storing, being movable down around the sides of the platform so that no further handling or offsite storage of components is required. The lowered panels create a neat appearing skirt for swim platforms when lowered to their stowed position suspended about the sides of the platform perimeter, which largely conceals the understructure and floats.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
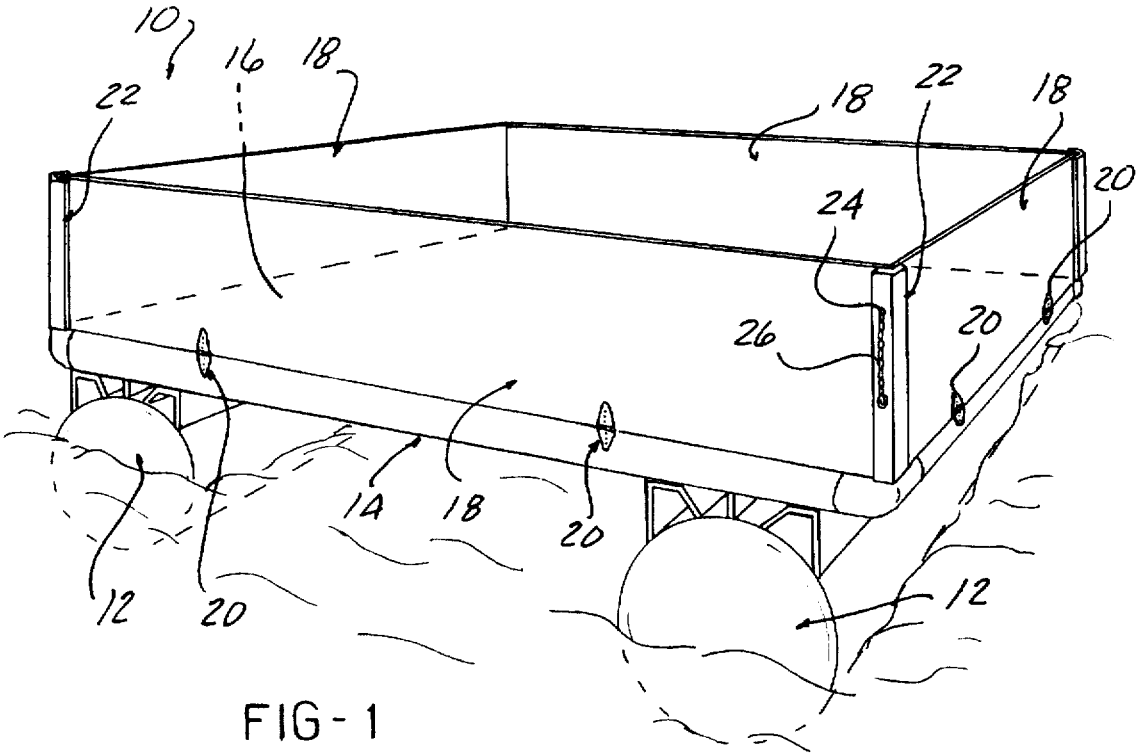
FIG. 1 is a perspective view of a swim raft equipped with an anti-roosting system according to the present invention comprised of a series of blocking panels shown in their raised, operative position.

Referring to the drawings and particularly FIG. 1, an aquatic platform comprising a swim raft 10 is shown. A pair of hollow cylindrical aluminum floats 12 support a rectangular platform 14 above the surface of a body of water. The raft 10 is typically anchored by being secured to a weight or fixed stake (not shown).

The top surface 16 of the platform 14 is used to support swimmers while relaxing, sunbathing, etc. Detachable boarding ladders (not shown) are typically provided for conveniently reaching the surface 16.

The anti-roosting system according to the present invention comprises a series of opaque vision blocking panels 18, each panel 18 extending coextensively along one side of the platform 14. The panels 18 are positioned uprightly as shown in FIG. 1, forming an open box-like structure enclosing the surface 16 so as to block the vision of alighting waterfowl.

An effective height of the upright panels of about 16 inches has been found to be effective to deter any waterfowl from roosting. A height in the range of about 12 to 20 inches should block the vision of most birds which are likely to become a nuisance.

The panels 18 may be supported by pairs of hinges 20 which allow the panels 18 to be flipped up and hooked together to be held in their upright position, or flipped down to their stowed position.

An opposing pair of panels 18 can have corner pieces 22 attached to help to hold the other pair of panels 18 upright. Locking pins 24 attached to chains 26 may also be employed to secure the panels 18 in their raised position.

Alternatively, the hinges 20 may be spring loaded to hold the panels 18 upright, panels 18 connected by corner attachments when lowered.

Figure 2:
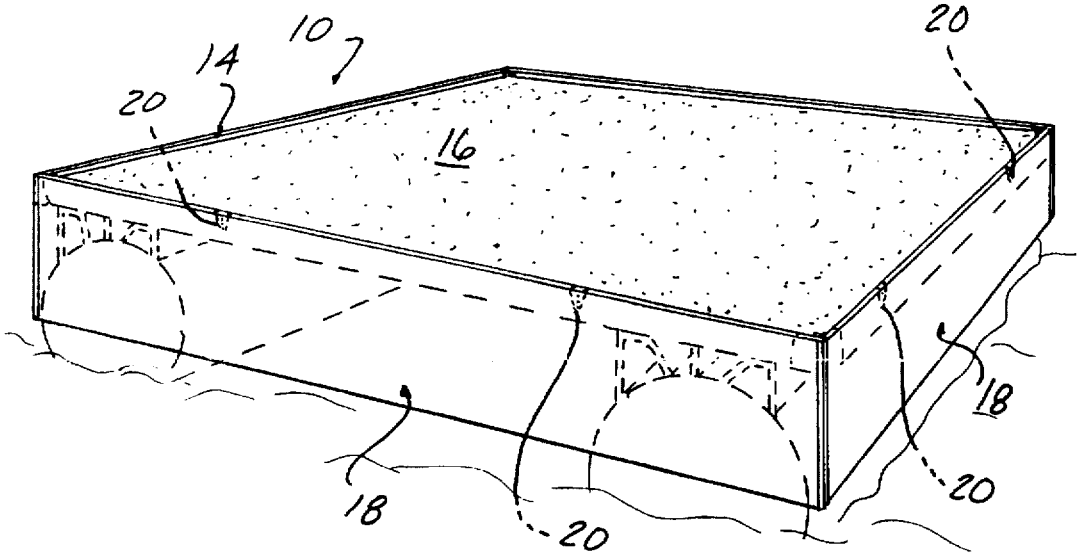
FIG. 2 is a perspective view of the swim raft shown in FIG. 1 with the blocking panels in their lowered, stowed position.

As shown in FIG. 2, the panels 18 are movable on their mountings to a lowered stowed position extending downwardly alongside the platform 14 by hinged downwardly flipping movement on hinges 20. This allows free access to the surface 16 (often carpeted as shown).

A ladder (not shown) stored on the surface 16 may then be installed.

Figure 3:
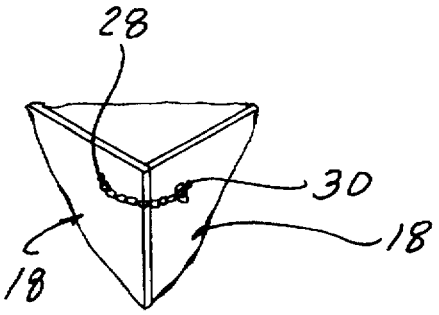
FIG. 3 is a fragmentary perspective view of a corner formed by two raised blocking panels showing an alternative connection for securing adjacent panels together in their raised position.

A simple corner securement shown in FIG. 3 may used to hold opposite corners of the panels 18 together when raised (or lowered when spring hinges are used). This may comprise a chain 28 attached to one panel 18 adjacent a side edge, with a hook or loop securement to another loop on the adjacent panel 18.

Figure 5:
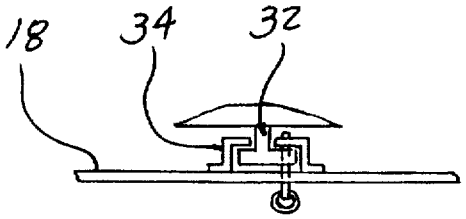
FIG. 5 is a fragmentary plan view of one of the panels and the slide components used in the mounting arrangement shown in FIG. 4.
Figure 4:
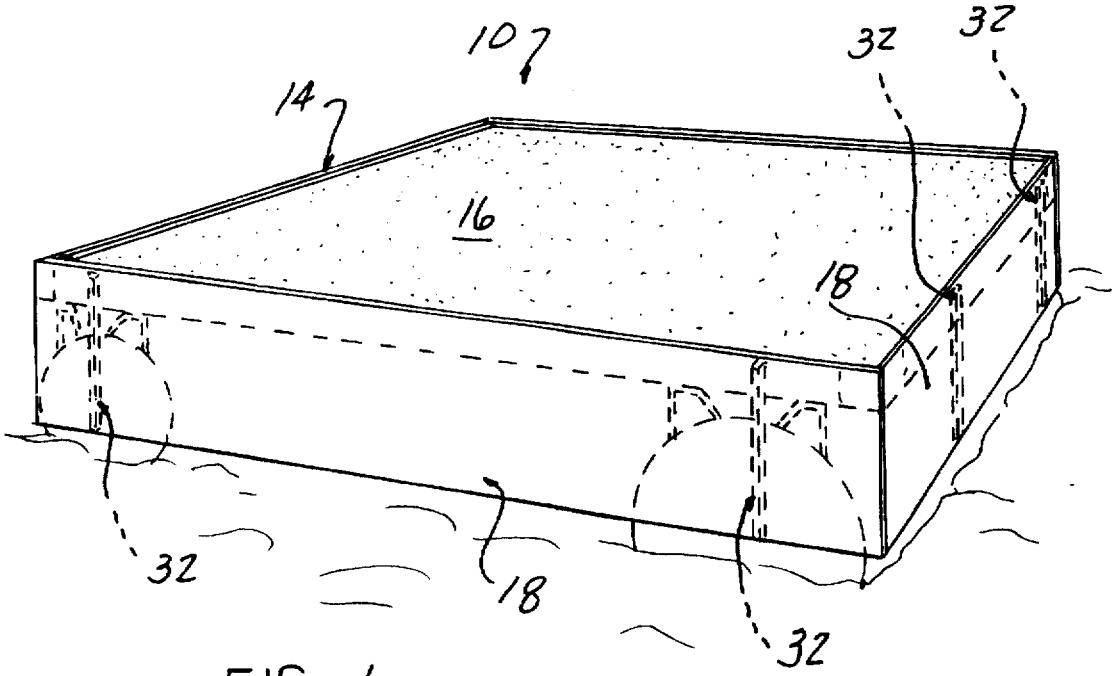
FIG. 4 is a perspective view of a swim raft with an alternative arrangement for mounting the blocking panels.

FIG. 4 shows pairs of vertical slides 32 welded or otherwise attached to the platform understructure slidably mounting the panels 18 for up and down movement. Each panel 18 has corresponding mating slides 34 attached thereto (FIG. 5). Removable pins 36 (or ball detents) hold the panels in a raised position extending above the platform surface 16.

Many other mounting arrangements are of course possible.

The panels 18 should be of a material which is opaque and sufficiently stiff to withstand the wind and rocking of the platform, and able to withstand weathering, such as painted plywood, plastic, etc.

In actual use over a summer season, this system was found to effectively deter roosting, while nearly swim rafts were hopelessly and constantly fouled by roosting waterfowl.

I claim:

1. An aquatic platform comprising a platform structure supported above a body of water and having a top planar surface spaced above the level of said body of water, said top surface defined by a series of sides forming a perimeter of said platform.

an anti-roosting system comprising a series of opaque, vision blocking panels, each panel extending along and parallel to a respective side of said platform, each panel mounted to said platform so as to be movable from an upright position extending upwardly from said platform top surface, to a stowed position alongside said platform extending downwardly from said surface to allow free access to said platform surface;

a releasable holder selectively holding said panels in said upright position, said panels when in said upright position deterring roosting of fowl on said surface by blocking outward viewing by fowl alighting on the top surface.

2. The platform according to claim 1 wherein said panels extend upwardly from said top surface a distance of about 12–18 inches.

3. The platform according to claim 1 wherein said aquatic platform comprises a swim raft, said platform structure supported on said body of water by floats.

4. The platform according to claim 1 wherein said panels are each hinged to said platform structure to be movably mounted thereto and swingable between said upright and stowed positions.

5. The platform according to claim 1 wherein said panels are slidably mounted to said platform structure so as to be vertically slidable between said upright and stowed position.

6. The platform according to claim 1 wherein said releasable holder comprises a connection at opposite corners formed at adjacent panel sides releasably holding said sides together.

7. The platform according to claim 6 wherein said platform structure has four sides and four panels are mounted thereto to form a box-like structure when said panels are raised.

* * * * *